US006047449A

United States Patent [19]

Pferdehirt

[11] Patent Number: 6,047,449

[45] Date of Patent: Apr. 11, 2000

[54] CAPPED RIVET

[75] Inventor: Thomas Pferdehirt, Wuppertal, Germany

[73] Assignee: YKK Corporation, Tokyo, Japan

[21] Appl. No.: 09/077,105

[22] PCT Filed: Sep. 18, 1997

[86] PCT No.: PCT/EP97/05121

§ 371 Date: May 19, 1999

§ 102(e) Date: May 19, 1999

[87] PCT Pub. No.: WO98/11799

PCT Pub. Date: Mar. 26, 1998

[30] Foreign Application Priority Data

Sep. 19, 1996 [DE] Germany ..... 196 38 450

[51] Int. Cl.[7] ..... A44B 1/44

[52] U.S. Cl. ..... 24/113 MP; 24/691; 24/94

[58] Field of Search ..... 24/113 R, 113 MP, 24/94, 95, 682.1, 688, 689, 691, 687; 411/520

[56] References Cited

U.S. PATENT DOCUMENTS 3,333,306 8/1967 Daddona, Jr. et al. .

5,745,964 5/1998 Luer et al. ..... 24/691 X

FOREIGN PATENT DOCUMENTS 0 146 133 A2 6/1985 European Pat. Off. .
0 191 424 A2 8/1986 European Pat. Off. .
0 216 081 A1 4/1987 European Pat. Off. .

*Primary Examiner*—James R. Brittain
*Attorney, Agent, or Firm*—Hill & Simpson

[57] ABSTRACT

In a capped rivet comprising a cap having an exposed upper surface and a lower surface, and a rivet having a rivet shaft extending in a direction away from the lower surface of the cap, a rivet flange extending in a horizontal direction away from an axis of the rivet shaft for fixedly attaching the rivet to the cap, and a pair of support portions disposed between the rivet shaft and the cap, extending substantially parallel to the lower surface of the cap, and formed by making a pair of apertures in the rivet flange and bending two portions of the rivet flange along bending lines respectively extending between the apertures and the rivet shaft, one support portion covers the other support portion by bending in such a manner that a surface of the one support portion that faces away from a lower surface of the cap at least partly contacts a surface of the other support portion that faces toward the lower surface of the cap.

12 Claims, 2 Drawing Sheets

STATE OF THE TECHNIQUE

PRIOR ART

CAPPED RIVET

FIELD OF THE INVENTION

The present invention general relates to capped rivets to be used with attaching elements,especially for fastening a snap button.

BACKGROUND OF THE INVENTION

One capped rivet according to the present invention comprises a cap having an exposed upper surface and a lower surface, and a rivet having a rivet shaft extending in a direction away from the lower surface of the cap, a rivet flange extending in a horizontal direction away from an axis of the rivet shaft for fixedly attaching the rivet to the cap, and a pair of support portions disposed between the rivet shaft and the cap, extending substantially parallel to the lower surface of the cap, and formed by making a pair of apertures in the rivet flange and bending two portions of the rivet flange along bending lines respectively extending between the apertures and the rivet shaft.

A capped rivet of this type is used, for example, for attaching a snap button, an ornamental or the like to a woven material to be supported such as a garment or a bag. For attachment, a rivet shaft is pierced through the supporting material and then deformed so as to attach the capped rivet fixedly to the supporting material. For protection of the supporting material and fastening of a snap button, firstly an eyelet or a spherical counterpart is brought up on the rivet shaft which has been pierced through the supporting material and then can be pressed against the supporting material by deformation of the rivet shaft. The deformation of the rivet shaft is generally done by using an attaching machine equipped with an attaching implement which contacts an exposed upper surface of the cap and pierces the rivet shaft through the supporting material and press it against a member holding a counterpart.

An existing capped rivet of the above-mentioned type is shown in FIG. 4. A rivet 110 of this capped rivet has, in addition to a rivet shaft 112 and a rivet flange 114, two support portions 120 disposed between the rivet shaft 112 and a cap 100 and extending substantially parallel to a lower surface of the cap. These support portions 120 are formed by means of making two apertures 118 at the two respective portions of the rivet flange and bending the two portions of the rivet flange along bending lines respectively extending between the apertures 118 and the rivet shaft 112. In order to avoid a problem of marking an impression on an upper surface of the cap 100 by the attaching implement, the support portions 120 has support surfaces for preventing the cap 100 from escaping toward the rivet shaft 112 by action of the attaching implement. Further, in the case of the capped rivet shown in FIG. 4, in order to prevent the supporting material from possible puckering when it is attached, the vertical interval X of a pressure-contact section 116 on a lower surface of the rivet flange 114 and a lower surface of an inwardly curved edge 106 of the cap 100 is reduced. The capped rivet of this type is known by EP-A2-0 146 133.

However, in use of the capped rivet of the type shown in FIG. 4, if the cap is made using thinner material for reduction of the material cost, an impression would be marked on the upper surface of the cap by the attaching implement.

In view of the foregoing problems, a main object of this invention is to provide a capped rivet which can be prevented from an impression of an attaching implement on an exposed upper surface of the cap when it is attached to a material to be supported, even when the cap is made from thin material.

In order to achieve the above object, it is proposed that in the capped rivet of the above-mentioned type, the support portions should be bent in such a manner that one support portion covers the other, wherein a surface of one support portion that faces away from an inner surface of the cap at least partly contacts a surface of the other support portion that faces toward the inner face of the cap.

With such an arrangement of the support portions, the other support portion that contacts the surface of the one support portion that faces away from the inner face of the cap has an additional support surface for keeping the one support portion from being escapingly moved when it comes into contact with the cap escaping toward the rivet shaft by action of the attaching implement. This can prevent a problem of marking an impression on the cap by the attaching implement during attachment of the capped rivet, even when a cap which is thin in material is used.

For manufacturing a capped rived according to this invention, relatively large support portions need to be cut out from the rivet flange and bent whereby the corresponding large apertures of the rivet flange are formed. Therefore, in order to make the rivet flange stable in spite of such large apertures formed in the rivet flange, the bending lines preferably extend substantially in parallel on two confronting side surfaces of the rivet shaft in such a manner that large non-aperture areas of the rivet flange extending between the apertures of the rivet flange are formed between the bending lines for reliably obtaining a desired stability of the rivet. Further, it is especially preferable that the apertures are substantially laterally symmetrical with respect to a plane including an axis of the rivet flange.

The other support portion that contacts the surface of the one support portion that faces away from the inner face of the cap is at least partly placed on the rivet flange and/or an upper edge of the rivet shaft, so that the cap can be stabilized so as not to move toward the rivet shaft.

In order to fasten the rivet to the cap, an outer edge of the rivet flange is preferably supported by a downwardly and inwardly curved outer edge of the cap below.

A pressure-contact section of the rivet flange, against which the supporting material is pressed after it is pierced through by the rivet shaft and the rivet shaft is deformed, is in contact with the rivet shaft and extends substantially perpendicularly to an axis of the rivet shaft, and further, when the support portions are disposed between the pressure-contact section and the cap, a relatively large interval can be kept with respect to the cap though an impression is prevented.

With this arrangement, when the rivet flange has a transitional section extending from the pressure-contact section toward the cap and an outer edge section extending horizontally from the transitional section away from the axis of the rivet shaft, a vertical interval can be especially reduced between the pressure-contact section of a lower surface of the rivet flange and a lower surface of the downwardly and inwardly curved outer edge of the cap, in order to fasten the rivet to the cap.

The cap of the capped rivet according to this invention has preferably a substantially semi-spherical shape.

In case that a counter part such as a spherical or an eyelet-like snap button is to be fastened to a surface of the supporting material that confront with the cap, it is especially preferable that a support surface of the counterpart which faces toward the rivet flange confronts with the pressure-contact section of the rivet flange.

This invention will be described below with reference to the drawings which clearly show all the basic details of this invention.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principals of the present invention and does not limit the broad aspects of the invention only to the illustrated embodiments.

Figure 1:
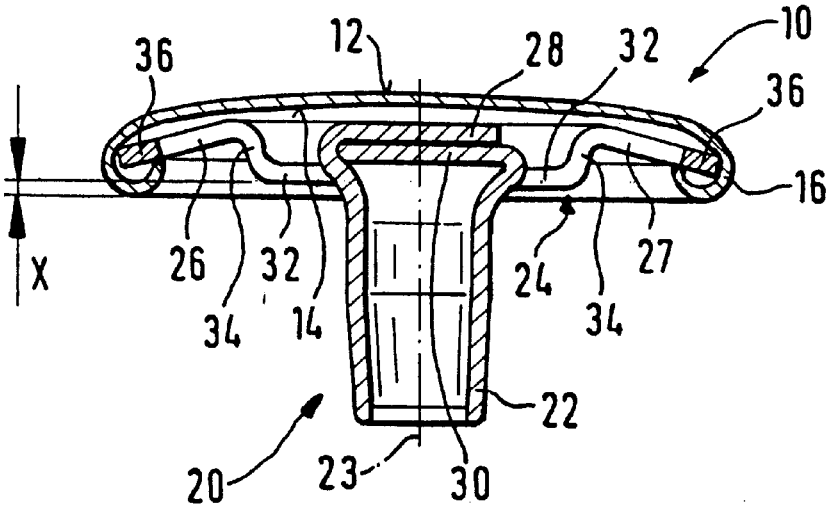
FIG. 1 is a cross-sectional view of a capped rivet according to this invention.
Figure 2:
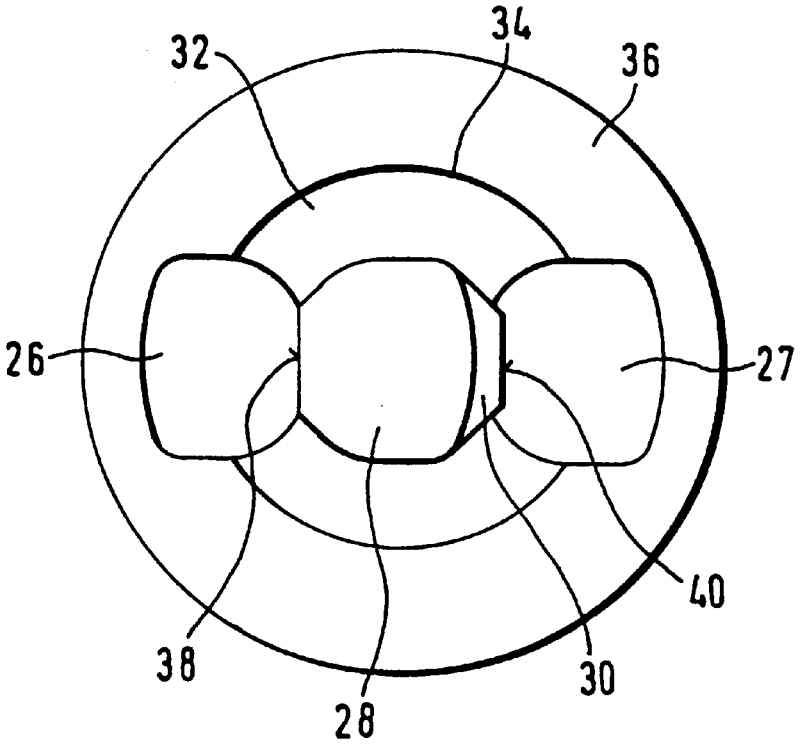
FIG. 2 is a plan view of the capped rivet according to this invention.

A capped rivet illustrated in FIG. 1 according to this invention has a cap 10 and a rivet 20 which basically comprises a rivet shaft 22 and a rivet flange 24 extending in a direction away therefrom. An outer edge 36 of the rivet flange 24 is supported on a downwardly and inwardly curved outer edge 16 of the cap 10 so that the rivet 20 is fixed to a lower surface of the cap 10. Between the rivet shaft 22 and the cap 10, disposed are a pair of support portions 28 and 30 which are formed by means of making apertures 26, 27 in the rivet flange 24 and bending the two portions of the rivet flange 24 along bending lines 38, 40 (see FIG. 2). At that time, the support portion 28 are bent so as to cover the support portion 30 in such a manner that a surface of the support portion 28 which faces away from the lower surface of the cap 10 contact a surface of the support portion 30 which faces toward the lower surface of the cap 10. As is apparent from FIG. 2, the bending lines 38, 40 extend substantially in parallel to each other on two confronting planes of the rivet shaft 22. As is apparent from FIG. 1 and FIG. 2, the apertures 26, 27 are formed in a substantially lateral symmetrical manner with respect to a plane including an axis 23 of the rivet shaft. Further, i t can be seen from FIG. 1 that an edge 31 of the support portion 30 opposite to the bending line 40 is disposed on an upper edge of the rivet shaft 22 or a boundary section between the rivet shaft 22 and the rivet flange 24.

The cylindrical rivet shaft 22 leads to a pressure-contact section 32 of the rivet flange 24 extending substantially perpendicularly to the axis 23 of the rivet shaft in a direction away therefrom, the pressure-contact section 32 leading to a transitional section 34 extending substantially parallel to the axis 23 of the rivet shaft and then to an outer edge 36 of the rivet flange extending in a lateral direction away from the axis 23 of the rivet shaft. Thereby, as is understood from FIG. 1, it is possible to reduce a vertical interval between a lower surface of the curved edge 16 of the cap 10 and a lower surface of the pressure-contact section 32 against which the supporting material with the rivet shaft 22 pierced therethrough is pressed after deformation of the rivet shaft 22. Further, as is understood from FIG. 1 and FIG. 2, the outer edge 36 of the rivet flange 24 and the pressure-contact section 32 are in a substantially circular form, and moreover, the apertures 26, 27 extend from the pressure-contact section 32 to a middle of the outer edge 36 of the rivet flange 24 via the transitional section 34. The cap 10 is in a substantially semi-spherical form and can be made from deformable metal. Also, the rivet 20 is preferably made from deformable metal.

Figure 3:
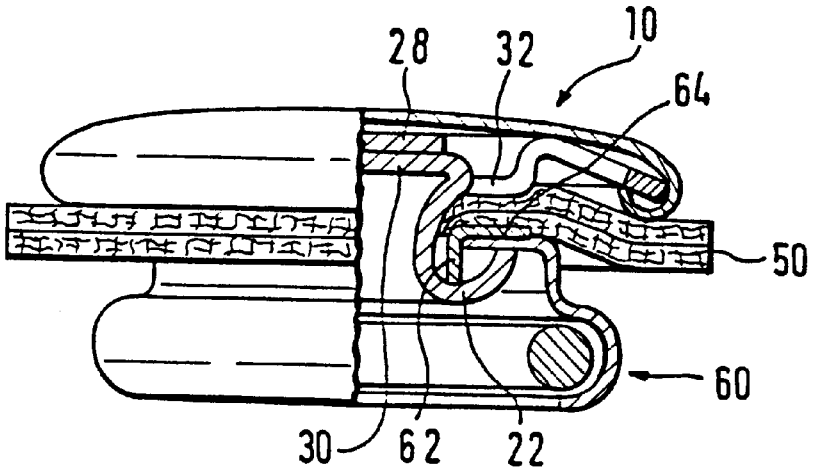
FIG. 3 is a view, partly in cross section, showing the capped rivet of FIG. 1 to be used for attaching an eyelet to the supporting material.
Figure 4:
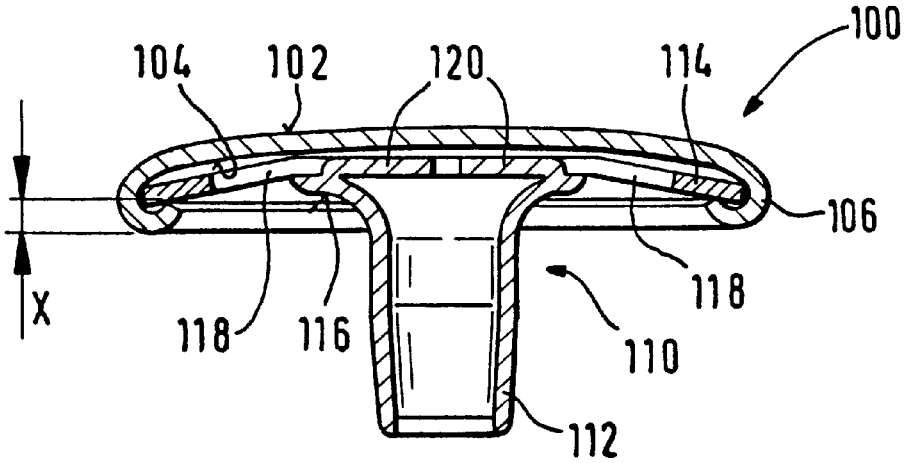
FIG. 4 a cross sectional view of the capped rivet according to the prior art.

FIG. 3 shows a snap button fastening device in a form of an eyelet 60 attached to the supporting material 50 as well as a capped rivet shown in FIG. 1. As is understood from this drawing, the rivet shaft 22 is pierced through the supporting material 50 and a central opening of the eyelet 60 for attaching, so that the central opening of the eyelet 60 is positioned, and then is bent upwardly and outwardly so as to cover an edge 62 of the eyelet 60 which extends substantially parallel to the axis 23 of the rivet shaft. In this case, in order that the capped rivet and the eyelet 60 are reliably secured to the supporting material 50, the supporting material 50 is compressed between a receiving surface 64 of the eyelet 60 which faces the pressure-contact section 32 of the rivet flange 24 and the pressure-contact section 32. Further, as is understood from FIG. 3, the supporting material will only slightly warp by the compression of the supporting material 50, as a result, the supporting material can be substantially completely kept from puckering.

This invention is not limited to the embodiments described with reference to the drawings. For example, a cap and/or a rivet flange in a different form may be used. Further, the capped rivet of this invention may have more than two support portions to be disposed between the rivet shaft and the cap. Lastly, the capped rivet of this invention may be, for example, fixed to the supporting material without using a counterpart such as an eyelet.

While the presently preferred embodiments have been illustrated and described, numerous changes in modifications can be made without significantly departing from the spirit and scope of this invention. Therefore, the inventor intends that such changes and modifications are covered by the appended claims.

The invention is claimed as:

1. A capped rivet comprising:

cap having an exposed upper surface and a lower surface; and a rivet having a rivet shaft extending in a direction away from the lower surface of the cap, a rivet flange extending in a horizontal direction away from an axis of the rivet shaft for fixedly attaching the rivet to the cap, and a pair of support portions disposed between the rivet shaft and the cap, extending substantially parallel to the lower surface of the cap, and formed by making a pair of apertures in the rivet flange and bending two portions of the rivet flange along bending lines respectively extending between the apertures and the rivet shaft;

wherein one support portion covers the other support portion by bending in such a manner that a surface of the one support portion that faces away from a lower surface of the cap at least partly contacts a surface of the other support portion that faces toward the lower surface of the cap.

2. A capped rivet according to claim 1, wherein the bending lines extend substantially in parallel to each other on two confronting side surfaces of the rivet shaft.

3. A capped rivet according to claim 1, wherein the apertures are substantially laterally symmetrical with respect to a plane including an axis of the rivet flange.

4. A capped rivet according to claim 1, wherein an edge of the other support portion that contacts the one support portion under the lower surface of the cap is at least partly placed on the rivet flange and/or an upper edge of the rivet shaft.

5. A capped rivet according to claim 1, wherein an outer edge of the rivet flange is supported by a downwardly and inwardly curved outer edge of the cap below so as to fasten the rivet to the cap.

6. A capped rivet according to claim 1, wherein the rivet flange has a pressure-contact section that is in contact with the rivet shaft and extends substantially perpendicularly to an axis of the rivet shaft, and that the support portions are disposed above the pressure-contact section.

7. A capped rivet according to claim 6, wherein the rivet flange has a transitional section extending from the pressure-contact section toward the cap and an outer edge section extending horizontally from the transitional section away from the axis of the rivet shaft.

8. A capped rivet according to claim 1, wherein the cap has a substantially semi-spherical shape.

9. A capped rivet according to anyone of the preceding claims, further comprising a counterpart that is slidable on the rivet shaft of the capped rivet and is fastened to the capped rivet by deformation of the rivet shaft.

10. A capped rivet according to claim 9, wherein a receiving surface of the counterpart member that faces toward the rivet flange confronts with the pressure-contact section of the rivet flange.

11. A capped rivet according to claim 10, wherein a supporting material is compressed between the rivet flange of the capped rivet and the counterpart member.

12. A capped rivet according to claim 9, wherein a supporting material is compressed between the rivet flange of the capped rivet and the counterpart member.

* * * * *